US009007202B1

(12) United States Patent
Chan et al.

(10) Patent No.: US 9,007,202 B1
(45) Date of Patent: Apr. 14, 2015

(54) HUMAN BEING TRACKING AND MONITORING SYSTEM

(71) Applicant: Endicott Interconnect Technologies, Inc., Endicott, NY (US)

(72) Inventors: Benson Chan, Vestal, NY (US); Jianzhuang Huang, Binghamton, NY (US); Subahu Desai, Vestal, NY (US)

(73) Assignees: Neil Michael Rego, Water Mill, NY (US); David Joseph Maines, Water Mill, NY (US)

( * ) Notice: Subject to any disclaimer, the term of this patent is extended or adjusted under 35 U.S.C. 154(b) by 0 days.

(21) Appl. No.: 13/778,499

(22) Filed: Feb. 27, 2013

(51) Int. Cl.
*G08B 1/08* (2006.01)
*G08B 21/02* (2006.01)

(52) U.S. Cl.
CPC ..... *G08B 21/02* (2013.01); *G08B 21/0269* (2013.01)

(58) Field of Classification Search
USPC ..... 340/539.13, 539.15, 573.3, 573.4
See application file for complete search history.

(56) References Cited

U.S. PATENT DOCUMENTS 4,899,135 A 2/1990 Ghahariiran
4,918,425 A * 4/1990 Greenberg et al. ..... 340/573.4
5,589,821 A 12/1996 Sallen et al.
5,621,388 A 4/1997 Sherburne et al.
5,652,569 A 7/1997 Gerstenberger et al.
5,661,460 A 8/1997 Sallen et al.
5,812,056 A 9/1998 Law
5,900,817 A 5/1999 Olmassakian
6,072,396 A * 6/2000 Gaukel ..... 340/573.4
6,078,260 A 6/2000 Desch
6,118,380 A 9/2000 Gannon
6,515,588 B1 * 2/2003 Sarabia ..... 340/568.1
6,529,131 B2 3/2003 Wentworth
6,570,504 B2 5/2003 Rabanne et al.
7,106,191 B1 9/2006 Liberati
7,259,682 B2 8/2007 Vannerus et al.
7,696,887 B1 4/2010 Echavarria
7,898,414 B2 3/2011 Spano
8,130,116 B1 3/2012 Daigle
8,154,401 B1 4/2012 Bertagna et al.
8,692,676 B2 * 4/2014 Touchton et al. ..... 340/539.13

* cited by examiner

*Primary Examiner* — John A Tweel, Jr.
(74) *Attorney, Agent, or Firm* — Mark Levy; Hinman, Howard & Kattell, LLP

(57) ABSTRACT

A human being tracking and monitoring system comprising parent and child units, each of which include a microcontroller, a transceiver, a crystal, a battery, a voltage regulator and a switch with all of these elements except the battery being strategically positioned on one side of a circuit board, manual activation of the two switches in a first predetermined manner establishing a communication link between the parent and child units wherein a plurality of random identification signals are generated, this communication link between said parent and child units being broken by activation of the switches in a second predetermined manner.

14 Claims, 4 Drawing Sheets

HUMAN BEING TRACKING AND MONITORING SYSTEM

FIELD OF THE INVENTION

The invention relates generally to tracking systems and more particularly to an electronic portable tracking system capable of monitoring the relative distance of a human being (e.g., child, disoriented senior citizen) from a receiver or base unit.

BACKGROUND OF THE INVENTION

Unfortunately, children, disoriented senior citizens and others become missing every day in this country and around the world. In some situations, this is the result of simply wandering off from a designated location while in other, more extreme situations, this may be the result of a kidnapping. Oftentimes, this happens in a matter of seconds unbeknownst to others, e.g., a parent or other caretaker, which in turn may possibly result in injury or even death to the lost person, as well as great concern and worry on the part of the caregiver(s).

The following cited patents describe various devices for tracking such lost persons, as well as personal items. The citation thereof is not an allegation that an all-inclusive search has been provided nor that any of these documents are prior art to the claimed invention.

In U.S. Pat. No. 8,154,401, issued to Bertagna, et al. on Apr. 10, 2012 for SYSTEM AND METHOD FOR COMMUNICATION WITH A TRACKING DEVICE, there is described a system for providing communication with a tracking device which includes a location detector, a communication device, memory, a processor, and a configuration routine. The location detector is operative to determine locations of the tracking device. The communication device is operative to communicate with a remote system. The memory stores data and code, the data including location data determined by the location detector and configuration data. The processor is operative to execute the code to impart functionality to the tracking device. The functionality of the tracking device depends at least in part on the configuration data. The configuration routine is operative to modify the configuration data responsive to communications from the remote system. Thus, functional access to the tracking device is provided to the remote system.

In U.S. Pat. No. 8,130,116, issued to Daigle on Mar. 6, 2012 for MOBILE TELEPHONE TRACKING SYSTEM, there is described a personal item tracking and monitoring system which includes transmitter and receiver units. The transmitter unit is attachable to an object, particularly a mobile telephone that emits a radio frequency coded signal to the receiver unit. The receiver unit is used to wirelessly lock and unlock the doors of a motor vehicle. As such, the receiver unit is envisioned to be carried on a ring of keys, carried in one's hands, carried in a pocket, purse, or briefcase, worn upon a belt, or a similar manner. The receiving unit allows a user to adjust and set an allowable distance between the object and the receiver unit using a range selection control. If the object is located farther then the allowable distance the user is alerting by an audible or visual warning signal. In such a manner, the user may take immediate corrective action to retrieve the object, thus silencing the alarm.

In U.S. Pat. No. 7,898,414, issued to Spano on Mar. 1, 2011 for SYSTEM FOR LOCATING AND PREVENTING THE LOSS OF PERSONAL ITEMS AND THE LIKE WITHIN A GEOGRAPHIC RANGE RELATIVE TO A USE, there is described a system for locating and preventing the loss of personal items within a geographic zone. The system components include a personal portable homing center device having a radio frequency receiver and a transducer that is actuated by a change in a signal strength, and several zone devices (e.g., an active RFID tag attached to the personal item). The homing center device uses an algorithm to measure the strength of the signal generated by the tag. The transducer may be an audible and/or silent alarm. The homing center device has three operating modes: Off, Homing-in, and Homing-out. In the Homing-in mode the alarm is actuated when a zone device's signal is detected. In the Homing-out operating mode, the alarm is actuated when a zone device's signal falls to a threshold strength, indicating that the item is no longer close to the homing center device.

In U.S. Pat. No. 7,696,887, issued to Echavarria on Apr. 13, 2010 for PERSON TRACKING AND COMMUNICATION SYSTEM, there is described a tracking system having a monitored unit and tracking unit with components that generate and transmit a recognizable audible, visual and, or tactile signal when the monitored unit travels beyond the distance threshold from the tracking unit to alarm the monitored person that they have traveled outside a designated safe area. The tracking unit further comprises circuitry and processor code that generates and transmits a signal that becomes increasingly stronger as the tracking unit gets closer to the monitored unit so as to generally indicate and direct the location of the monitored unit.

In U.S. Pat. No. 7,259,682, issued to Vannerus, et al. on Aug. 21, 2007 for CHILD DISTANCE AND WATER IMMERSION ALARM, there is described a system of monitoring human beings which combines zone and water alarms, including an alarm unit to be arranged on a human being's body and a portable alarm centre handled by a person who monitors the human being. The alarm unit includes a sender for continuous wireless transfer of intermittent signals on a first channel and transfer of an arbitrary type of signal on a second channel, such that the alarm centre receives signals sent from both channels for status monitoring of the alarm unit. Activation of an alarm is achieved in the alarm centre when the intermittent signal differs from a predetermined intermittent signal state.

In U.S. Pat. No. 7,106,191, issued to Liberati on Sep. 12, 2006 for CHILD DISTANCE MONITORING AND ALERTING SYSTEM, there is described a child distance and alerting system which includes a transmitter unit to be attached to a child's clothing and a receiver unit to be carried by a parent or guardian supervising the child for preventing the child from wandering away too great a distance. The transmitter unit includes a disc-shaped body, a pin portion extending outwardly there-from for piercing an article of clothing, and a pin-receiving component adapted for releasably clamping the pin portion so that the transmitter unit can be attached to the child's clothing. Once the pin portion and the pin-receiving component are properly joined, the transmitter unit cannot be removed from the child's clothing except by use of a special tool. The transmitter unit is designed to transmit radio frequency signals and remains activated until the pin-receiving component is removed from the pin portion. The receiver unit receives the radio frequency signals and produces either an audible warning sound or a silent vibrating warning whenever the transmitter unit has traveled outside the predetermined distance from the receiver unit.

In U.S. Pat. No. 6,570,504, issued to Rabanne, et al. on May 27, 2003 for SYSTEM FOR TRACKING POSSESSIONS, there is described a system for selectively detecting the presence of a plurality of objects in proximity to a person. The system includes a plurality of child units each having a first communicating device (e.g., transceiver) for sending a locator signal and for receiving a control signal. Further, the system includes a parent unit having a second communicating device for receiving the locator signal, a processor for monitoring the child unit and for determining whether the child unit is within a preselected range, at least one alarm for signaling the person when the selected child unit is outside the preselected range, and controls for selectively controlling the child units to be monitored and for controlling activation of the child units.

In U.S. Pat. No. 6,529,131, issued to Wentworth on Mar. 4, 2003 for ELECTRONIC TETHER, there is described an apparatus for determining distance and location of a subordinate unit relative to a master unit (e.g., one person relative to another). Both master and subordinate unit consist of a GPS receiver, an RF transceiver, a power supply, an electronic compass, and user interface and microprocessor. The master unit periodically polls and exchanges data with the subordinate unit using RF signals. The master unit processes the data and displays it on a display as distance and direction to a subordinate unit. The subordinate unit also processes data and displays it on a display as distance and direction to the master unit. Additionally, the master unit compares the data to user selectable predefined parameters. If the data is not within those parameters, the master unit initiates an alarm condition at both the master and subordinate unit.

In U.S. Pat. No. 6,118,380, issued to Gannon on Sep. 12, 2000 for SWITCH ARRANGEMENT FOR CHILD FINDER APPARATUS, there is described a child locator device which includes a housing unit provided with a rear face equipped with an elongated clip arm and containing a control unit including an alarm signal speaker for generating an alarm signal in response to the actuation of a first switch responsive to the position of the clip arm relative to the rear face of the housing unit and a second switch member normally hidden by the clip arm for overriding the first switch.

In U.S. Pat. No. 6,078,260, issued to Desch on Jun. 20, 2000 for METHOD AND APPARATUS FOR KEEPING TRACK OF CHILDREN, there is described a system for monitoring the proximity and location of a child by a parent which includes two transceiver units which communicate wirelessly. The child unit transmits a signal to the parent unit so that the parent unit can determine the proximity of the child unit and its direction. A safe zone may be set by controls on the parent unit. When the child unit moves beyond the safe zone, the parent unit will generate an alert.

In U.S. Pat. No. 5,900,817, issued to Olmassakian on May 4, 1999 for CHILD MONITORING SYSTEM, there is described a monitoring system for indicating to a supervisory individual, such as an adult, when a monitored individual, such as a child, has moved beyond a safe predefined maximum distance limit. The monitoring system includes a first electronic module suitably fixed to the monitored individual and arranged to exchange signals that are useful to determine the relative distance and direction the first electronic module is from a suitable second electronic module. The second electronic module in the possession of the supervisory individual is arranged to exchange signal information with the first electronic module and indicate to the supervisory individual information including the distance between and direction of the monitored individual. Should the distance between the monitored and supervisory individuals increase beyond the maximum distance limit, an alarm situation may be annunciated by an audio annunciator (or other suitable annunciation device). The second electronic module includes a direction display and distance display that may be employed by the supervisory individual to locate the monitored individual.

In U.S. Pat. No. 5,812,056, issued to Law on Sep. 22, 1998 for CHILD LOCATING AND MONITORING DEVICE, there is described a wireless child monitoring and location device consisting of a device pair having a guardian unit and a child unit, both of which are operable in the 900 MHz frequency band in the presence of other wireless devices transmitting and receiving within the same frequency band. The guardian unit is able to detect when a child strays beyond a preset distance. The child and guardian units execute a selected digital operating address or channel and establish a time marker used to synchronize transmission between the units. This allows each child/guardian pair to operate in the presence of similarly configured devices without the undesirable possibility of interference among the devices. The child and guardian units are capable of electronically reconnecting if communication between the units is interrupted. The guardian unit is capable of communicating a preset delay period to the child unit to offset the start point of the time marker to avoid jamming from other similarly configured units operating in the vicinity.

In U.S. Pat. No. 5,661,460, issued to Sallen, et al. on Aug. 26, 1997 for DISTANCE DETERMINATION AND ALARM SYSTEM, there is described a system which includes a plurality of transceiver units, including a parent unit and one or more portable and wearable child units, for generating an alarm when a child transceiver unit is more than a predetermined distance away from a parent transceiver unit. The distance is determined by the difference in the phase of a reference signal from the time it is transmitted on an RF signal by a parent unit, received and retransmitted by a child unit, and then received again by the parent unit.

In U.S. Pat. No. 5,652,569, issued to Gerstenberger, et al. on Jul. 29, 1997 for CHILD ALARM, there is described a child alarm device consisting of a guardian transmitter and a child receiver. If the child wanders out of range of the guardian's transmitter, after a short delay, an audible alarm is triggered in the child's receiver automatically. One of the child's alarms can be triggered manually by the guardian. As an optional "Panic Button", the child can also trigger an alarm. The child's receiver has one group identification code and recognizes only one channel code. The guardian can control more than one channel within the same group code to watch over more than one child.

In U.S. Pat. No. 5,621,388, issued to Sherburne, et al. on Apr. 15, 1997 for SYSTEM FOR MONITORING AND LOCATING A PERSON WITHIN A PRESELECTED DISTANCE FROM A BASE-STATION, there is described a system for monitoring and locating the position of persons, animals or moving objects which consists of a base-station that generates an interrogation signal which, when detected by one or more transceiver units triggers the one or more of the transceiver units to generate a return signal. Each of the transceiver units, upon being located outside the preselected distance or upon becoming inoperable, detects an interruption in the interrogation signal, ceases to generate the return signal, alerts the user of the transceiver unit and, after a delay period, initiates a homing signal. The base-station, upon detecting an interruption in the return signal from any one of the transceiver units, triggers a delay period for that transceiver unit and, upon expiration of the delay period, triggers locating circuitry to determine the position of the transceiver unit. Moreover, the base-station operates independently for each of the one or more transceiver units.

In U.S. Pat. No. 5,589,821, issued to Sallen, et al. on Dec. 31, 1996 for DISTANCE DETERMINATION AND ALARM SYSTEM, there is described a system having a plurality of transceiver units for generating an alarm when a child transceiver unit is more than a predetermined distance away from a parent transceiver unit. The system consists of a portable parent unit, a first transmitter portion, disposed in the parent unit, and having a first RF transmitter operative at a first carrier frequency, a signal generator for generating a first reference signal, a first FM modulator coupled to the first RF transmitter for modulating the first carrier with the first reference signal and a first digital encoder for digitally encoding the FM-modulated carrier with a digital signature to identify the output of the first transmitter. The system further consists of a portable child unit of a size permitting it to be worn by a human subject and including a second receiver tuned to the first carrier frequency for receiving a signal broadcast from the output of the first transmitter, a digital decoder for decoding the digital signature from the signal received by the second receiver and providing a decoded output, an inhibitor arrangement coupled to the digital decoder for preventing transmission by the child unit unless the decoded output meets criteria stored in the child unit, a second RF transmitter operative at a second carrier frequency and having an output, and a second FM modulator coupled to the second RF transmitter and to the second receiver for modulating the second carrier with a second reference signal having a pre-specified phase relationship to the first reference signal as received by the second receiver. This system still further consists of a first receiver portion disposed in the parent unit and having a first receiver tuned to the second carrier frequency for providing an output of the demodulated second reference signal, a distance resolver coupled to the first receiver and the signal generator for providing an output signal dependent on the phase relationship between the first reference signal and the demodulated second reference signal that is indicative of the distance between the child unit and the parent unit and an alarm coupled to the distance resolver and triggered if the output signal from the distance resolver exceeds a specified maximum distance.

In U.S. Pat. No. 4,899,135, issued to Ghahariiran on Feb. 6, 1990 for CHILD MONITORING DEVICE, there is described a range sensitive system employing two or more ultra sonic transceivers to monitor the activities of a child, children or individuals and carrying transceivers monitored by a base transceiver carried by a guardian. The system consists of the transceivers operating in ultra sonic frequency spectrum, the child's transceiver transmitting a constant signal which is received by the guardian's transceiver which converts the signal into an audio tone, the guardian's transceiver having a threshold receiving circuit adjustable to correlate a prescribed distance from the transceiver carried by the child (the loss of a signal from the child's transceiver energizing an audio generator in the guardian's transceiver), a signal from the guardian's transceiver energizing an audio tone transmitter in the child's transceiver, the child's transceiver carried in a holster having means to open the transmission circuit if the transceiver is removed from the holster and the child's transceiver in the holster being attached to the child by a support belt having means to open the transmission circuit if the belt is removed from the child.

As to be understood from the teachings herein, the present invention comprises a human being tracking and monitoring system capable of precisely tracking and monitoring the location of one human being, e.g., a child, relative to a predetermined location occupied by another person, e.g., parent. The invention as defined herein is relatively simple to operate and relatively inexpensive (compared to many of the more complex assemblies as described above) to produce. It is believed that such a system will represent a significant advancement in the art.

OBJECTS AND SUMMARY OF THE INVENTION

It is a primary object of the present invention to provide a tracking system that triggers an alarm when a monitored person travels beyond a predetermined distance from a monitoring device located at a pre-determined base location.

It is another object of the instant invention to provide a tracking system that transmits a warning signal to a person carrying a unit when this person wanders beyond said predetermined distance from said pre-determined location.

It is yet another object of the instant invention to provide a tracking system that activates a warning signal from a receiver unit when a targeted (tracked) person having this unit travels beyond a predetermined distance from the receiver unit's pre-determined location.

It is a still further object of this invention to provide such a system which may be manufactured using, for the most part, conventional electronic components and using, for the most part, conventional manufacturing processes.

According to one aspect of this invention, there is provided human being tracking and monitoring system comprising a parent unit including a first circuit board, a first microcontroller positioned on the first circuit board for data processing and control, a first transceiver also positioned on the first circuit board for transmitting first data from the first microcontroller and for passing received second data to the first microcontroller, a first crystal also positioned on the first circuit board for generating clock signals to the first transceiver, a first battery also positioned on the first circuit board for powering the first microcontroller and first transceiver, a first voltage regulator also positioned on the first circuit board for regulating voltage of the first battery to ensure static power levels to the microcontroller and transceiver and a first switch adapted for allowing manual activation of this parent unit. In addition, the system includes a child unit including a second circuit board, a second microcontroller positioned on the second circuit board for data processing and control, a second transceiver also positioned on the second circuit board for transmitting this second data from the second microcontroller to the first transceiver and for receiving the first data from the first transceiver and passing this first data to the second microcontroller, a second crystal also positioned on the second circuit board for generating clock signals to the second transceiver, a second battery also positioned on the second circuit board for powering the second microcontroller and second transceiver, a second voltage regulator also positioned on the second circuit board for regulating voltage of the second battery for ensuring static power level to the second microcontroller and second transceiver and a second switch adapted for allowing manual activation of the child unit, this manual activation of the first switch of the parent unit and the second switch of the child unit in a first predetermined manner establishing a communication link between parent and child units wherein a plurality of random identification signals are generated, this communication link between parent and child units being broken by subsequent manual activation of the first and second switches in a second predetermined manner.

BEST MODE FOR CARRYING OUT THE INVENTION

For a better understanding of the present invention, together with other and further objects, advantages and capabilities thereof, reference is made to the following disclosure and appended claims in connection with the above-described drawings. It is understood that like numerals will be used to indicate like elements from FIG. to FIG.

TERMINOLOGY

The following terms will be used herein, among others, to define various elements of this invention.

By the term "human being tracking and monitoring system" is meant a system designed specifically for the purpose of ascertaining the exact whereabouts of one person relative to the exact whereabouts of another person. Such as system, as defined herein, must include at least one "parent unit" and at least one "child unit" but may also include additional "child units."

By the term "child unit" when used herein to define one of the system's units is meant a unit adapted for being positioned on any human being, child or adult, whose exact whereabouts are to be tracked and monitored.

By the term "parent unit" when used herein to define one of the system's units is meant a unit designed as a base or home unit which is adapted for being utilized by a second person, e.g., typically an adult parent or caregiver, but could be any person having the necessary responsibility, to determine the exact whereabouts of the human being having the "child unit" in order to monitor said human being's location and/or movements.

Figure 1:
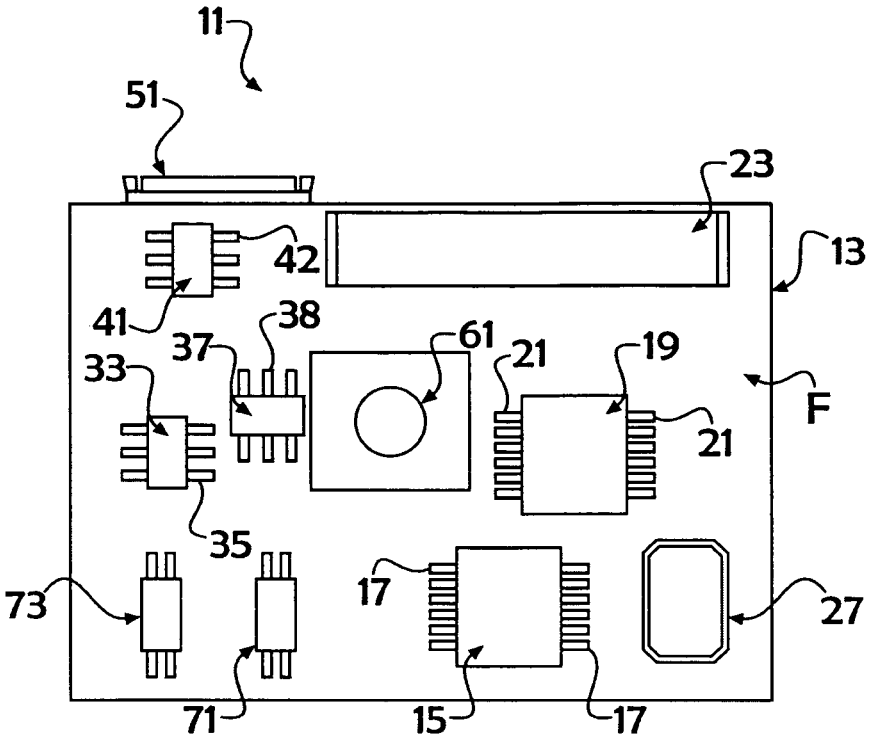
FIG. 1 is a front view of a subassembly which, when housed in an appropriate housing (defined further below) will function as the "child" unit of a human being tracking and monitoring system according to one embodiment of the invention.
Figure 2:
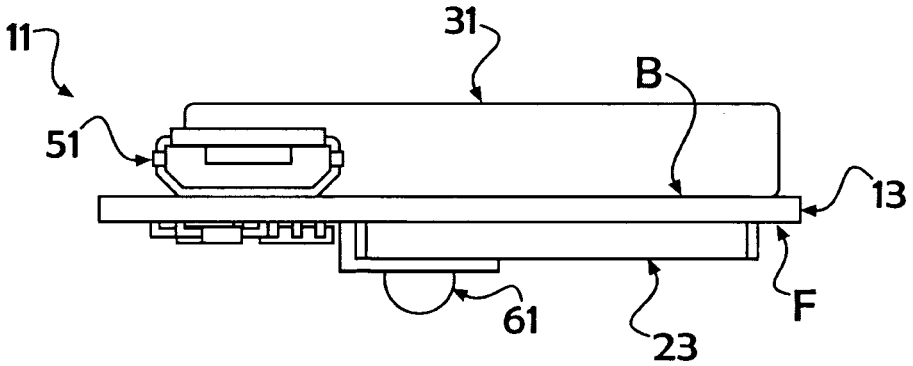
FIG. 2 is a top view of the "child" subassembly of FIG. 1.
Figure 3:
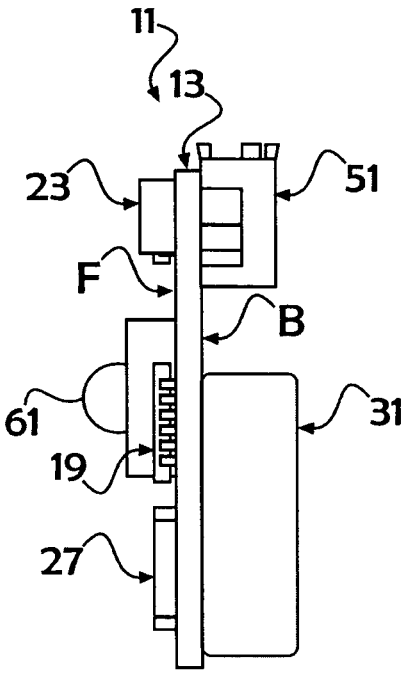
FIG. 3 is a side view of the subassembly of FIG. 1.
Figure 4:
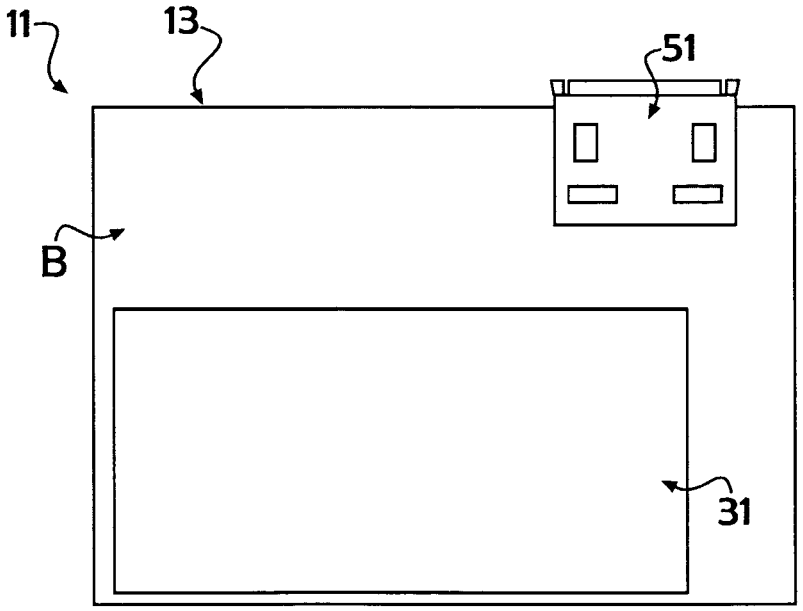
FIG. 4 is a rear view of the subassembly of FIG. 1.

In FIG. 1, there is shown a subassembly 11 which will form the core of a "child" unit of a human being tracking and monitoring system according to one embodiment of this invention. It is understood that at a minimum, the tracking and monitoring system of this invention includes a "parent" unit and at least one "child" unit, albeit it is possible to utilize more than one such "child" units with a singular "parent" unit. As mentioned above, this subassembly 11 is designed for being positioned within a suitable housing such as that shown and described in greater detail with respect to FIG. 7 and elsewhere below. Subassembly 11 for the "child" unit includes a base member in the form of a printed circuit board (or card) 13 including thereon appropriate electrical contact sites (described more below) which form part of the board's circuitry. As is known, boards of this type may include contact sites and circuitry on both opposing sides of the board in addition to internal circuitry within the board's dielectric material, which circuitry in turn may interconnect the opposing contact sites and thus the electronic components mounted thereon. Board 13 of this part of the invention possesses all of these capabilities and features, as shown and understood from the drawings and further description herein. It is to be understood that the strategic mounting of the unit's elements on a common board represent a significant feature of each of the units of this invention.

Mounted on the front side F of board 13 are several components, which work cooperatively in the manner defined herein to provide the required functions of this invention. A first of these components is a microcontroller 15 (that is, a small computer on a single integrated circuit (chip) which contains a processor core). Program memory is also included on the single chip, as well as a relatively minor amount of RAM (random access memory). As is known, microcontrollers are used in embedded applications, such as automobile engine control systems, implantable medical devices, remote controls, office machines, appliances, power tools, toys, etc. One example of a microcontroller adapted for use in this invention is a series PIC12F microcontroller from Microchip Technology, having a business location at 2355 West Chandler Blvd. Chandler, Ariz. This microcontroller may have from eight to fourteen pins 17 (fourteen shown in FIG. 1, of which six are I/O (input/output) pins) which, as is known, are inserted within associated receiving contacts (not shown) in board 13. Features of this particular type of microcontroller include sixteen stack levels, flash memory (with self read/write capability), an internal 32 MHz oscillator, a data signal modulator module, a comparator with selectable voltage reference, two 8-bit timers and one 16-bit timer, in circuit serial programming and on board in-circuit debug. Microcontroller 15 further includes an RF (radio frequency) transmitter operable in four MHz bands with eight selectable center frequencies. It is also FSK (frequency shift keying) operational up to 100 kbps (kilobits per second) and OOK (on-off keying) operational up to 10 kbps. Its low power features include a standby current of thirty nA (nanoamperes) at three volts (530 nA at sleep) with operating currents of only 0.67 mA (milliamperes) with RF off, and up to 17.17 mA at 10 dBm (power ratio) during operation.

Functional in cooperation with microcontroller 15 is a RF transceiver 19, located adjacent the microcontroller on side F. In one embodiment, transceiver 19 is a MRF49XA transceiver (also available from Microchip Technology) which is fully integrated. This single chip ISM (industrial-scientific-medical) band sub-GHz (giga hertz) transceiver includes a frequency synthesizer clocked by an external 10 MHz crystal and which generates the desired MHz radio frequencies in the three ranges above of microcontroller 15. The receiver with zero-IF architecture includes the following components: (1) LNA (low noise amplifier); (2) down conversion mixers; (3) channel filters; (4) baseband limiting amplifiers; and (5) receiver signal strength indicator. The transmitter with direct conversion architecture has a typical output power of +7 dBm. An internal transmit/receive switch combines the transmitter and receiver circuits into differential RFP and RFN pins (all referenced by the numbers 21 in FIG. 1) which in turn are connected to the impedance matching circuitry (Balun) and to the external antenna connected to the transceiver. The transceiver operates in the low-voltage range of 2.2V-3.8V, and in sleep mode, operates at very low-current.

Positioned on side F of board 13 is an antenna 23 for the transceiver unit cited above, the antenna coupled to this components via the board's internal circuitry as mentioned above.

Side F of board 13 of this "child" unit of the invention further includes an ultra miniature contour mode quartz ceramic SMD crystal 27 available under the product name ABM3B from the Abracon Corporation, having a place of business at 30332 Esperanza, Rancho Santa Margarita, Calif. In this particular example, crystal 27 is operational from eight MHz (mega-Hertz) to fifty MHz (in the fundamental mode) and 50.1 MHz to 125 MHZ (in the 3$^{rd}$ overtone mode). It has a shunt capacitance of seven pF (pico-Farads) and a load capacitance of eighteen pF. For added strength, the ceramic crystal is covered with a metal lid (facing the viewer in FIG. 1).

Power for the unit (subassembly) of FIGS. 1-4 is provided by a re-chargeable battery 31 (FIGS. 2-4) mounted on the opposite side (B) of board 13. In one embodiment, battery 31 is sold under the product number 30117-0 by Tenergy Corporation, having a place of business at 436 Kato Terrace, Fremont, Calif. This particular battery is Li-Poly (lithium-ion-polymer) 3.7V, 60 mAh battery having a maximum charge current of 1 A, a maximum charge voltage of 4.2 volts, a charge operational temperature range of zero to forty-five degrees C. (Celsius) and discharge operational temperature of −20 degrees C. to +60 degrees C. The battery also has a minimum capacity of 50 mAh (milliampere hours) and, significantly, is rechargeable up to 500 times. Battery 31 is charged, as needed, by a battery charger 33, located almost directly opposite battery 31 on side F. Charger 33, in one embodiment, is a standalone linear li-ion (lithium-ion) battery charger sold under the product name LTC4054L-4.2 by Linear Technology, having a place of business at 1630 McCarthy Blvd., Milpitas, Calif. No external sense resistor is needed for this particular charger, and no blocking diode is required due to the internal MOSFET architecture. Thermal feedback regulates the charge current to eliminate thermal overdesign. The charge voltage is fixed at 4.2V, and the charge current can be programmed externally with a single resistor. As seen in the drawings, the charger is mounted to side F using leads 35 which in turn may be soldered to accommodating contact site pads (not shown) on the board surface F which in turn form part of the board's overall circuitry. These leads are thus connected thru the board to the opposite side battery 31 to accomplish charging.

Working in conjunction with the battery 31 is a low voltage indicator 37 positioned on side F (with leads 38, similar to leads 35) adjacent charger 33 and directly opposite battery 31 positioned on the back side B. In one embodiment, an indicator sold under the product designation LTC1998 and available from Linear Technology (cited above) may be used. This indicator possesses one percent accuracy, adjustable threshold voltage and hysteresis, a quiescent current rating of only 2.5 uA, programmable thresholds of 2.5 V to 3.25 V, and, significantly, a low profile package. Low voltage indicator 37 functions to provide an indication when the voltage of battery 31 reaches a specified low level that re-charging is necessary, at which time charger 33 kicks into operation.

Voltage regulation for subassembly 11 is provided by a voltage regulator 41, mounted on side F using leads 42 in the same manner as charger 33. In one embodiment, regulator 41 is a compact 600 mA, three mHz step-down DC to DC converter sold under the product code ADP2108 by Analog Devices, having a place of business at 831 Woburn Street, Wilmington, Mass. This regulator uses a proprietary, high speed current mode, constant frequency PWM (pulse width modulation) control scheme for excellent stability and transient response. To ensure the longest battery life in portable applications, the ADP2108 regulator has a power save mode that reduces the switching frequency under light load conditions. It also runs on input voltages of 2.3 V to 5.5 V, which allows for single lithium or lithium polymer cell power sources of the type defined above. The maximum load current of 600 mA is achievable across the input voltage range.

Figure 7:
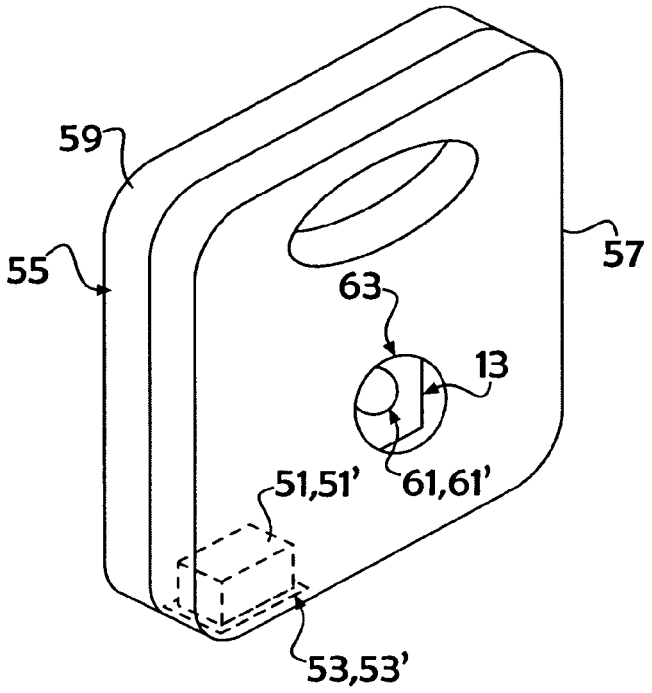
FIG. 7 is a perspective view of the "child" unit of a human being tracking and monitoring assembly according to the FIG. 1 embodiment of the invention (which includes the subassembly of FIGS. 1-4 above), contained within a housing according to one embodiment of the invention, it being understood that FIG. 7 is substantially identical to a perspective view of the "parent" unit of FIG. 5 similarly contained within a housing and which thus forms the second part of the human being tracking and monitoring assembly of the invention.

To enable updating of the microcontroller 15 firmware, in addition to enabling downloading of data from the microcontroller (if desired), subassembly 11 further includes a USB (universal serial bus) connector 51 mounted on side B of board 13 opposite voltage regulator 41. Connector 51 is surface mounted on corresponding contract sites (not shown) on side B's external circuitry to in turn be connected to the microcontroller 15 via internal circuitry of the board. In one embodiment, a USB connector sold under the product number C-1981568-1 and made by TE Connectivity AMP (formerly Tyco Electronics AMP) having a place of business at 1050 Westlakes Drive, Berwyn, Pa., may be successfully utilized. This particular connector is a Series B right angle single port, five position receptacle with surface mount termination and is also available with optional metal-to-metal grounding fingers. In the unit (either parent or child in this embodiment of the invention since both are substantially similar when housed) shown in FIG. 7, it is understood that the USB connector is accessed through a bottom opening (represented by the hidden line to number 53), the connector 51 also shown hidden relative thereto. Preferably, the opening 53 in the housing (referenced by number 55 in FIG. 7) is located on the lower or bottom wall of the housing and thus substantially prevented from having adverse foreign matter, e.g., dust, dirt, rain, enter the opening and potentially interfere with the connector's operation. A shield (not shown) may be simply placed over the opening if desired to further assure foreign matter inclusion. In FIG. 7, housing 55 is preferably plastic, lightweight, and includes two facing portions 57 and 59 which readily snap together once the FIG. 1 subassembly is mounted therein. To accomplish this mounting, either portion includes mounting tabs which align with the subassembly such that the subassembly snugly fits within the portion. Securing the two portions together, including by snapping or more permanently using a suitable cement or adhesive, assures the subassembly being fixedly secured in position. Such snaps, projecting tabs, cements, etc. are well within the scope of one versed in the art and further description is not necessary.

Turning the respective unit on and off is accomplished using a push button switch 61, which includes a single button which is easily reachable through a second opening 63 within one of the portions (here, portion 57) of the unit's housing 55 as seen in FIG. 7. In this embodiment, the button of switch 61 is located substantially centrally on and projects from a button housing which in turn is secured to side F and thereby electrically coupled to the board's circuitry. This single button is easily seen in FIG. 7. Several single button key switches are known in the art which may provide this feature and further description is not necessary. In the particular embodiment of FIG. 1, red and green surface mount LED's 71 and 73, respectively, are positioned on side F adjacent switch 61 to show the user/operator of the unit using subassembly 11 that the unit is either on or off. As indicated, these are surface mounted, meaning that leads thereof are solder attached to corresponding contact sites on the surface of side F, which sites form part of the subassembly's circuitry and are thus connected to switch 61 through the internal portion of this circuitry. In one embodiment, the green LED may be one of the SML-310 series of LED available from ROHM Semiconductor, having a place of business at 6815 Flanders Drive, San Diego, Calif. One particular one of these series is sold under the product number SML-310PTT86. This LED possesses a forward voltage of 2.2 V, a dominant wavelength of 560 nm and a peak wavelength of 555 nm, all of which assure sufficient light emission for the invention. A low test current of only 20 mA is also possible. One example of a red LED usable in the invention is also available from ROHM Semiconductor under their SML-D12 series, a preferred on sold under the product number SML-D12V8WT86. This LED possesses similar characteristics as the above red LED, including being surface mounted.

Although specific examples of various components have been cited above for use in this invention, it is understood that the invention is not limited to these particular products in that suitable substitutes are possible.

The above components make up the subassembly 11 which is then positioned within a housing structure such as shown in FIG. 7. It is seen and understood that this part of the invention thus uses a minimum of components, which for the most part are readily attainable on the market, and which are capable of being mounted on a circuit board using conventional mounting procedures known in the printed circuit board art. Of equal significance, almost all of each unit's elements are mounted on a single side of the respective unit's board, thereby assuring ease of manufacture and product testing, while facilitating eventual repair and replacement if necessary.

Another particularly advantageous feature of the invention defined herein is the similarity of both the child and parent units, thereby assuring substantial savings in total product cost, including manufacturing thereof. As evidence of this, attention is directed to FIG. 5 wherein subassembly 11' is shown. Subassembly 11', in this embodiment, is designed for being utilized in the parent unit of the invention. As such, it includes many similar components as the child unit subassembly 11, many of which are similarly mounted on and electrically coupled (and connected). Among these similar components mounted on a similar board 13' are microcontroller 15' (including having leads 17'), RF transceiver 19' (including leads 21'), antenna 23', quartz ceramic SMD crystal 27', re-chargeable battery 31' (FIG. 6), battery charger 33' (with leads 35'), low voltage indicator 37'(with leads 38'), voltage regulator 41'(with leads 42'), USB connector 51', push button switch 61' and red and green surface mount LED's 71' and 73', respectively. Preferably, the components listed above for subassembly 11' are identical to those for subassembly 11, e.g., microcontroller 15' is a series PIC12F microcontroller from Microchip Technology. (Appropriate substitutes are possible however, including replacements in the field as necessary, without adversely affecting the operational capabilities of this invention). This similar strategic positioning further assures that subassembly 11' will fit similarly within a housing like that shown in FIG. 7, even further assuring reduced manufacturing time and final product costs.

Figure 5:
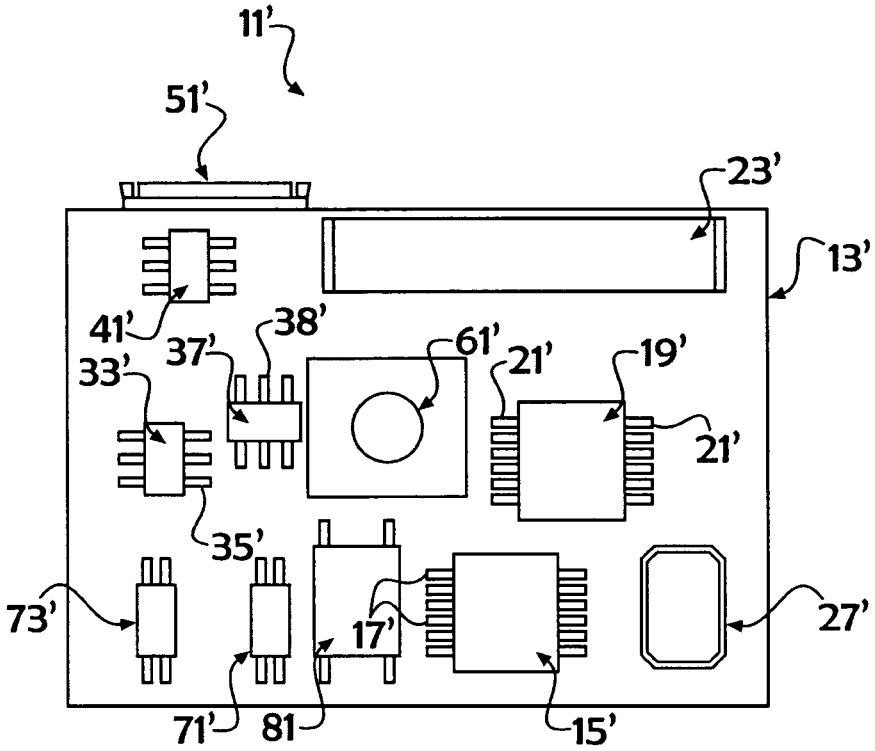
FIG. 5 is a front view of a subassembly which, when housed in an appropriate housing (defined further below) will function as the "parent" unit of a human being tracking and monitoring assembly according to one embodiment of the invention.
Figure 6:
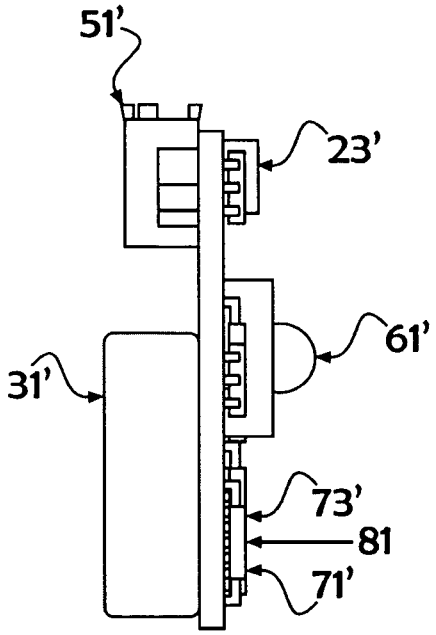
FIG. 6 is a side view of the "parent" subassembly of FIG. 5.

Subassembly 11' may differ from that of the child unit by the addition of an alarm component 81. In one embodiment, alarm 81 is a surface mounted audio buzzer having an operating voltage of only 2-4 volts, a current rating of 100 mA, and is operable at a resonant frequency of 4000 Hz. The sound pressure level provided by this buzzer is about 78 dBA (A-weighted decibels), which is clearly sufficient to indicate to the parent unit operator that an alarm level has been reached and action needs to be taken. Buzzers of this type are available from a variety of sources, the particular manufacturer of this buzzer being PUI Audio, Inc., having a place of business at 3541 Stop Eight Road, Dayton, Ohio. As seen in FIG. 5, alarm 81 is positioned on the front side of board 13' adjacent switch 61' and is thus able to emit sound through the same housing opening through which activation of the switch is accomplished (see again FIG. 7). Separate venting (not shown) may be provided in one side of the housing for this purpose, if desired. It is within the scope of this invention to also provide an alarm buzzer similar to buzzer 81 on the invention's child unit, including at the same location shown in FIG. 5 for parent unit subassembly 11'. Minor movement of the associated LED's 71 and 73, i.e., to the same relative locations shown in FIG. 5, would be necessary.

Although the parent unit is described above as different in at least one detail (the alarm) compared to the child unit, it is within the scope for both units to be the same construction, e.g., both may include an alarm or both none, depending on operational requirements for the final product. For example, a customer may require a loud audible signal if tracking small children to assure the children hear the signal and are thus more likely to comply.

To shield each of the two units from water, dust, etc., it is possible to apply a coating of parylene (particularly, parylene C) over the entire external surfaces thereof. Coating is possible using chemical vapor deposition or other suitable means. A more recent material capable of providing such protection is one used to protect cell phones from water, that being Liquipel, a nano-coating applied using what is referred to as a proprietary process wherein the item to be protected is positioned within a "Liquipel Machine" to first remove moisture and then apply the coating. The company named Liquipel has a business location at 2911 Tech Center Drive, Santa Ana, Calif. Other means of providing such protection for the invention are of course also possible and within the skills of those versed in the art.

Figure 8:
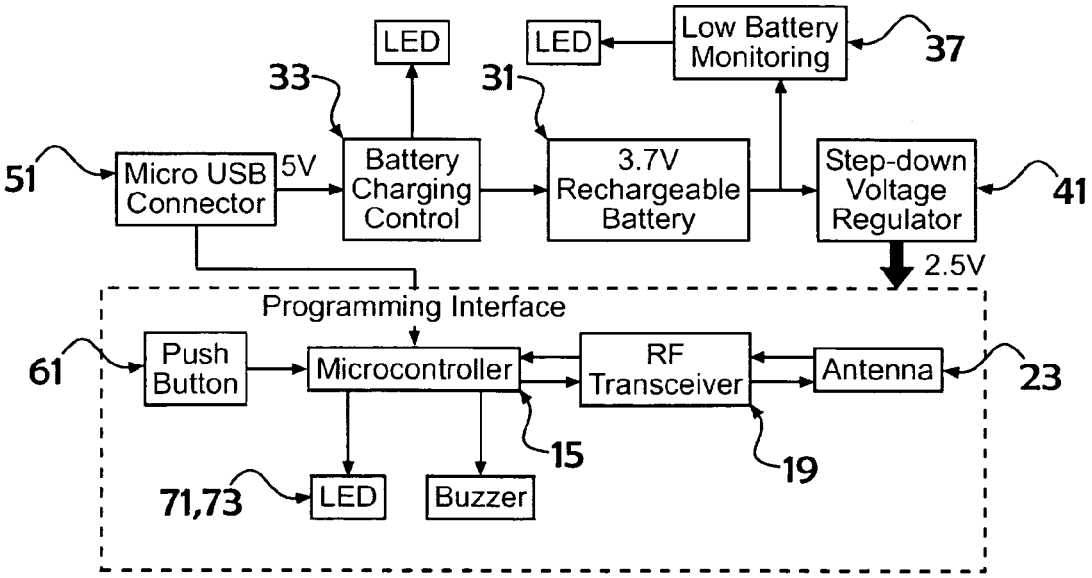
FIG. 8 is a basic circuit diagram representative of the typical elements of either one of the somewhat similar parent and child units of the invention, and how these elements are coupled together electronically.

Attention is directed particularly to FIG. 8 which depicts a circuit diagram of the various elements which make up both the individual parent and child units of the invention, as described above. Added elements, such as a warning audible buzzer and LED's to indicate low battery levels and re-charging of the battery are also shown, and, as mentioned, these are elements which may be incorporated within one or both of the units. The following paragraphs are provided to even further define the functioning of the invention's elements, particularly with respect to one another.

Microcontrollers 15 and 15' are utilized for handling all data processing for their respective units. Each receives and transmits data through the respective RF transceivers 19 and 19' when buttons 61, 61' are depressed by the unit operator. The microcontrollers also drive the respective LED's (71, 73, 71' and 73') and, if utilized, the buzzer alarm 81 to thereby assure both visual and audio alarms if desired. The microcontrollers also contain flash memory for storing firmware programs and random access memory (RAM) for run-time data usage. As mentioned, firmware can be updated through the programming interface connected through the connectors 51 and 51'. The transceivers, being of the sub-GHz type, handle communications between coupled units using, preferably, FSK modulation, and, in one example, the units operate at a carrier frequency of 868 MHz. The respective antenna elements, 23 and 23', as defined above, are chip module types specifically built for the desired 868 MHz transmission band, but are adaptable for a broader range of bands if needed.

The output of batteries 31 and 31' is regulated by the voltage regulators 41 and 41', respectively, using step down switching, while battery output monitoring is provided by a detection circuit within each of the respective low voltage indicators 37 and 37', respectively. When these circuits monitor a predetermined low voltage, these then may also activate a LED, in addition to the above defined battery charger (33 or 33'), to recharge the respective battery to its acceptable working level. Battery charging is also possible for the individual units by using the USB connector, which in turn is coupled to an acceptable power source. The charging process is controlled by a charging circuit, and, if desired, a LED is turned on when charging is in progress, and off when the battery is fully charged. These LED's are not shown in the drawings but it is well understood that those similar to LED's 71 and 73 may be used, these mounted on the board and electrically coupled into the respective unit's circuitry.

Manually depressing one of the buttons (61 or 61') enables the respective unit to assume one of two modes: normal/power-on mode or sleep/power-off mode. In sleep/power-off mode, both the microcontroller and the RF transceiver are in power saving mode, whereas in the normal/power-on mode, both of these elements are actively engaged. In normal/power-on mode, if one unit has not been coupled to the other unit (or others if more than one child unit is utilized), continual depressing of the button activates the coupling (communication) process between the units. This communication coupling process is terminated if the button is released. Significantly, when the button is held for more than one second, the unit enters a slave mode and a request for coupling is sent through the transceiver to the other unit. If no response is received from the other unit (or units) and the button is continuously held for two more seconds, the transmitting unit enters a master mode. During master mode, if a request for coupling is received from a second unit in slave mode, a message for accepting the coupling is sent along with a random-generated identification ID signal. When the second unit receives the message and ID, the second unit configures itself as a slave unit and saves the ID in memory. It also sends an acknowledgement back to the unit (e.g., parent) which is in master mode. When the acknowledgement is received, the unit in master mode configures itself as a master unit and saves the ID that is assigned to the slave unit.

Once parent and child units are coupled, the parent sends out a tracking signal periodically to the coupled slave child unit. If more than one child unit are coupled to the parent unit, the parent sends out such a tracking signal to each child unit, in a sequential manner. When a child unit receives a tracking signal with its ID, it calculates the distance to its parent unit based on the strength of the received signal. It then sends an acknowledgement back to the parent unit. If the distance of the parent unit exceeds a predetermined range, or if the parent's tracking signal is not received for a certain period of time, acoustic and visual alarms are triggered through the described buzzer and LED elements. When a parent unit receives an acknowledgement with an ID that the parent had sent, the parent calculates the distance of the child (slave) unit based on the strength of the received signal. If the distance of the child unit exceeds the predetermined range, or if no acknowledgement is received for a certain period of time, acoustic and visual alarms are triggered through associated buzzer and LED elements on the unit.

Button activation is further significant from a timing standpoint. For example, depressing the button of a slave unit during normal/power-on mode for more than one second causes the slave unit to send a request for decoupling from the parent master unit every second until a response is received. Once coupled, a particular child slave unit cannot be coupled to other units since it is programmed to only send out one decoupling request. In comparison, depressing the button of a parent master unit during normal/power-on mode for more than one second causes the parent to enter master mode while also causing the parent to continuously listen for requests for coupling or decoupling. If the parent receives a request for coupling, the coupling process described above is repeated and the parent is now coupled with an additional child slave unit. If a request for decoupling is received, the receiving parent unit checks the ID extracted from the child unit's request message. If the ID exists in the parent's programmed memory, the parent sends a message acknowledging the decoupling request and erases the child ID from its memory. If no ID remains in the parent's memory after decoupling, the parent configures itself as a non-coupled unit. When the child slave unit in turn receives the acknowledgment, it also erases its ID in memory and configures itself as a non-coupled unit.

It is thus understood from the foregoing that manual activation of the first switch (of the parent unit) and the second switch (of the child unit) in a first predetermined manner serves to establish a communication link (coupling) between parent and child units in which a plurality of random identification (ID) signals are generated and received. Further, it is understood that this communication link may then be broken (terminated) by subsequent manual activation of both switches in a second predetermined manner.

Using particular LED flashing patterns enables the unit user to determine whether his/her unit is configured as a master, slave or a non-coupled unit. In a child slave unit, a LED is flashed at a fixed frequency, while in the parent unit a LED is flashed at a higher frequency than the child unit. Further, the frequency varies depending on the distance to the coupled child unit, with higher frequency indicating greater distances between units. When the units are not coupled, no LED is flashed.

All IDs stored in the memory of a unit may be erased completely by formatting the unit. Formatting is accomplished by switching the unit into sleep/power-off mode and then holding the button for more than three seconds. Formatting a unit in this manner serves to erase all data memory which stores the IDs, but not flash memory that stores the firmware program. When a unit is formatted, a message is sent out to all its coupled units to in turn force decoupling. If a coupled unit fails to receive the message, the unit will still need to be formatted in order to remove the obsolete ID.

Each of the units of the invention includes a very small housing (i.e., 55 in FIG. 7). By way of example, the housing in FIG. 7 had dimensions of only 1.18 inch wide, 1.26 inch high and 0.394 inch thick. In addition, each of the housings may include an opening (not shown) to accept a chain (the unit then being a pendant) or it may have a clip (not shown) affixed to it for clipping the housing onto a person's article of clothing.

There has thus been shown and described a human being tracking and monitoring system which possess many significant advantages, including, among others, dynamic unit pairing and un-pairing with a hand-shaking algorithm, single unit pairs with multiple units (single-single, single-multi), FSK modulation (e.g., using a specific carrier band, such as 868 MHz as may be used in the invention for long transmission range), distance calculation based on received signal strength, simple LED indication, an alarm when one of the paired units is out of the predetermined range or not being detected, alarms on both units if desired, a programmable microcontroller to allow firmware updating, low battery monitoring and indication, an embedded charging circuit to recharge the invention's battery (thus, no battery replacement is necessary), a single button to assure simple operation (the button also usable as a panic button), an overall small enclosure with no detachable part (e.g., in the FIG. 7 embodiments, which may be either the parent or child units defined with respect to the other drawings FIGS., the dimensions are only 1.18 inch wide, 1.26 inch high, and only 0.394 inch tall), and, if desired, a pendant/clip-on for easy attachment. Of further significance, positioning of most of the individual elements of each unit on one side of the unit's circuit board enables relatively ease of repair and/or element replacement, as well as ease of manufacturing, and the associated reduced costs inherently derived therefrom.

While there have been shown and described what are at present the preferred embodiments of the invention, it will be obvious to those skilled in the art that various changes and modifications may be made therein without departing from the scope of the invention as defined by the appended claims.

What is claimed is:

1. A human being tracking and monitoring system comprising:

a parent unit including a first circuit board, a first microcontroller positioned on said first circuit board for data processing and control, a first transceiver also positioned on said first circuit board for transmitting first data from said first microcontroller and for passing received second data to said first microcontroller, a first crystal also positioned on said first circuit board for generating clock signals to said first transceiver, a first battery also positioned on said first circuit board for powering said first microcontroller and said first transceiver, a first voltage regulator also positioned on said first circuit board for regulating said voltage of said first battery for ensuring static power level to said microcontroller and said transceiver and a first switch adapted for allowing manual activation of said parent unit; and a child unit including a second circuit board, a second microcontroller positioned on said second circuit board for data processing and control, a second transceiver also positioned on said second circuit board for transmitting said second data from said second microcontroller to said first transceiver and for receiving said first data from said first transceiver and passing said first data to said second microcontroller, a second crystal also positioned on said second circuit board for generating clock signals to said second transceiver, a second battery also positioned on said second circuit board for powering said second microcontroller and said second transceiver, a second voltage regulator also positioned on said second circuit board for regulating said voltage of said second battery for ensuring static power level to said second microcontroller and said second transceiver and a second switch adapted for allowing manual activation of said child unit, said manual activation of said first switch of said parent unit and said second switch of said child unit in a first predetermined manner establishing a communication link between said parent and child units wherein a plurality of random identification signals are generated, said communication link between said parent and child units being broken by subsequent manual activation of said first and second switches in a second predetermined manner.

2. The human being tracking and monitoring system of claim 1 wherein said first microcontroller, said first transceiver, said first crystal and said first voltage regulator are all positioned on the same side of said first circuit board and said first battery is positioned on an opposite side of said first circuit board.

3. The human being tracking and monitoring system of claim 2 wherein said second microcontroller, said second transceiver, said second crystal and said second voltage regulator are all positioned on the same side of said second circuit board and said second battery is positioned on an opposite side of said second circuit board.

4. The human being tracking and monitoring system of claim 2 further comprising a first battery charger for charging said first battery when said first battery reaches a predetermined low level, said first battery charger being positioned on the same side of said first circuit board as said first microcontroller, said first transceiver, said first crystal and said first voltage regulator.

5. The human being tracking and monitoring system of claim 4 further comprising a second battery charger for charging said second battery when said second battery reaches a predetermined low level said second battery charger being positioned on the same side of said second circuit board as said second microcontroller, said second transceiver, said second crystal and said second voltage regulator.

6. The human being tracking and monitoring system of claim 4 further including a low battery monitor also positioned on said same side of said first circuit board as said first microcontroller, said first transceiver, said first crystal and said first voltage regulator for providing a signal when said first battery reaches said predetermined first low level.

7. The human being tracking and monitoring system of claim 6 further including a low battery monitor also positioned on said same side of said second circuit board as said second microcontroller, said second transceiver, said second crystal and said second voltage regulator for providing a signal when said second battery reaches said predetermined second low level.

8. The human being tracking and monitoring system of claim 6 further including at least one LED and at least one buzzer also positioned on said same side of said first circuit board as said low battery monitor, said first microcontroller, said first transceiver, said first crystal and said first voltage regulator for providing first visual and audible alarms from said parent unit, respectively.

9. The human being tracking and monitoring system of claim 8 further including at least one LED and at least one buzzer also positioned on said same side of said second circuit board as said low battery monitor, said second microcontroller, said second transceiver, said second crystal and said second voltage regulator for providing second visual and audible alarms from said child unit, respectively.

10. The human being tracking and monitoring system of claim 1 further including first and second housings, said parent and child units being positioned substantially within said first and second housings, respectively.

11. The human being tracking and monitoring system of claim 10 wherein each of said first and second housings includes an opening therein, said first switch of said parent unit being positioned within said opening of said first housing and said second switch of said child unit being positioned within said opening of said second housing.

12. The human being tracking and monitoring system of claim 1 wherein each of said first and second microcontrollers comprise flash memory with self read/write capability, an internal oscillator, a data signal modulator module, a comparator with selectable voltage reference, at least one timer and an RF transmitter.

13. The human being tracking and monitoring system of claim 1 further including a first antenna also positioned on said same side of said first circuit board as said low battery monitor, said first microcontroller, said first transceiver, said first crystal and said first voltage regulator, said first antenna being coupled to said first transceiver.

14. The human being tracking and monitoring system of claim 13 further including a second antenna also positioned on said same side of said second circuit board as said low battery monitor, said second microcontroller, said second transceiver, said second crystal and said second voltage regulator, said second antenna being coupled to said second transceiver.

* * * * *